US005897434A

United States Patent [19]

Arbucci

[11] Patent Number: 5,897,434

[45] Date of Patent: Apr. 27, 1999

[54] CHIMNEY CAP HOOD

[76] Inventor: Christopher B. Arbucci, 359 N. Hickory St., Massapequa, N.Y. 11758

[21] Appl. No.: 08/947,518

[22] Filed: Oct. 24, 1997

[51] Int. Cl.[6] ..... F23L 17/02

[52] U.S. Cl. ..... 454/12; 454/35

[58] Field of Search ..... 454/3, 12, 13, 454/14, 35

[56] References Cited

U.S. PATENT DOCUMENTS

| | | | |
|---|---|---|---|
| Re. 27,943 | 3/1974 | Smith . | |
| 462,127 | 10/1891 | Hanson . | |
| 494,454 | 3/1893 | Ashton . | |
| 555,643 | 3/1896 | Gordon . | |
| 678,083 | 7/1901 | Witte . | |
| 850,126 | 4/1907 | Bayley . | |
| 920,763 | 5/1909 | Lauritzen . | |
| 1,588,321 | 6/1926 | Lord | 454/35 |
| 2,229,212 | 1/1941 | Kreutzer . | |
| 2,582,905 | 1/1952 | Harmon | 454/12 X |
| 2,766,678 | 10/1956 | Morris . | |
| 2,821,900 | 2/1958 | Primich . | |
| 2,956,495 | 10/1960 | Sublette . | |
| 2,976,796 | 3/1961 | Anthony et al. | 454/74 |
| 3,089,521 | 5/1963 | Paiement . | |
| 3,173,354 | 3/1965 | Kinkead et al. . | |
| 3,232,207 | 2/1966 | Gibbons . | |
| 3,345,932 | 10/1967 | Sauer . | |
| 3,363,369 | 1/1968 | Miller . | |
| 3,363,538 | 1/1968 | Stoneman . | |
| 3,631,789 | 1/1972 | Kinsey . | |
| 3,685,426 | 8/1972 | Rosa . | |
| 4,007,759 | 2/1977 | Martin et al. . | |
| 4,202,255 | 5/1980 | McNamara | 454/12 |
| 4,334,460 | 6/1982 | Simmons et al. . | |
| 4,436,021 | 3/1984 | Hisey | 454/12 |
| 4,549,473 | 10/1985 | Alexander . | |
| 4,593,510 | 6/1986 | Newsome . | |
| 4,686,807 | 8/1987 | Newsome . | |
| 4,731,967 | 3/1988 | McLaughlin . | |
| 4,732,078 | 3/1988 | Giumenta et al. | 454/12 X |
| 4,811,534 | 3/1989 | Newsome . | |
| 4,846,147 | 7/1989 | Townsend . | |
| 4,909,135 | 3/1990 | Greko . | |
| 4,955,167 | 9/1990 | Holtgreve . | |
| 5,003,739 | 4/1991 | Newsome . | |
| 5,246,464 | 9/1993 | Brazell . | |
| 5,402,613 | 4/1995 | Giumenta et al. . | |

FOREIGN PATENT DOCUMENTS

| | | | |
|---|---|---|---|
| 2614675 | 11/1988 | France . | |
| 721849 | 1/1955 | United Kingdom | 454/35 |

*Primary Examiner*—Harold Joyce
*Attorney, Agent, or Firm*—Baker & Botts, LLP

[57] ABSTRACT

A detachable chimney cap hood which can be attached to the side walls of a chimney cap without the need for nuts, bolts, screws or tools and allows the hood to be later removed manually. The hood includes a cover portion and one or more locking clips attached to the cover portion. Guide pieces can also be included to align the hood onto the chimney cap. The locking clips and guide pieces hold the hood in place. The hood allows a person to attach and remove the hood manually without a wrench or other tool when a chimney flue needs to be cleaned. This feature is especially desirable when the chimney cap is cemented or otherwise permanently affixed to the chimney flue because the hood of the chimney cap must be separately removed in order to access the one or more chimney flues covered by the cap.

22 Claims, 3 Drawing Sheets

CHIMNEY CAP HOOD

FIELD OF INVENTION

The present invention relates to a chimney cap hood which is detachable from the sides of the chimney cap and which does not require nuts, bolts or screws as the hood attachment mechanism.

BACKGROUND OF THE INVENTION

Chimney caps are designed to be placed on top of and enclose the upper end of a chimney flue. The chimney cap prevents rain, hail, leaves, small animals and other possible obstructions from entering the chimney flue. Chimney caps also prevent birds and squirrels from nesting in an infrequently used chimney. Conventional chimney caps can be formed from a pliable metal material such as steel. The four sides of the cap are conventionally created by bending a single sheet of metal into the four sides in succession. The hood (or roof) of the cap is typically welded onto the side pieces to form a single finished unit. In some chimney caps, flanges are welded to the bottom of each side to form a shelf which is placed on top of the chimney flue and supports the cap. The cap can be further secured by screws on each side of the chimney cap in order to hold the cap in place next to the flue. A chimney cap can also be permanently secured to the chimney by either cementing tabs located on the bottom of the chimney cap to the crown area, applying an adhesive to the chimney cap tabs and the crown area, using masonry screws to bolt the cap directly onto the crown or surrounding area or using any combination of the above or other known techniques.

Multiple flue chimney caps which cover more than one flue are advantageous to use instead of individual chimney caps if two or more flues are located together on the roof of a building. A house may have two or more fireplaces with separate chimney flues and may additionally have a furnace or wood burning stove with a separate flue. Many times in the design of the house, the flues are located next to each other on the roof. Multiflue chimney caps can be used to cover all of the flues with one chimney cap which can save money and improve the overall appearance. Multiflue chimney caps are typically permanently affixed to the flue area and require a removable hood in order to clean one or the more of the covered chimney flues. Permanent chimney caps conventionally attach the hood of the caps with screws, nuts and bolts which must be removed using a tool such as a wrench.

When a chimney flue requires cleaning after normal use, the nonpermanent chimney cap with a welded on hood is normally removed from the chimney by unscrewing the nuts from the bolts on the sides of the cap which hold the cap in place on the chimney flue. This removal operation typically requires a tool such a wrench or pair of plyers to loosen the nuts or screws sufficiently so that the entire cap can be removed. The cap must then be placed safely out of the way on the ground or other area so that the chimney sweep does not injury himself while cleaning the flue. The bolts and nuts must be carefully stored so that they do not fall to the ground or get lost. It would be advantageous to have a removable chimney cap hood which can be removed from the rest of the chimney cap and replaced manually without the need for extra tools and which does not have loose bolts or screws.

A collapsible chimney cap is a cap which can be assembled at the point of installation. A collapsible chimney cap is usually shipped in multiple pieces, typically four individual side pieces, a hood, screws or bolts for holding the cap onto the chimney flue and screws or bolts for attaching the hood to the four side walls. The hood is typically connected to each of the side walls by placing the bolt through the sidewall and the hood. Welding operations are not practical when assembling a chimney cap on the roof. A nut placed on each bolt then holds the hood in the place. While some collapsible chimney cap hoods can be removed since they are not welded, it would normally necessitate using a wrench or plyers to unscrew the nut from the bolt. It is undesirable to perform such a mechanical operation on a roof a house where a chimney sweep or house owner could drop the nuts and bolts or lose his balance and fall from the roof.

It would be advantageous to design a chimney cap with a detachable hood which would allow for easy installation of the hood onto the cap and additionally allow easy removal of the hood when required.

SUMMARY OF THE INVENTION

The detachable chimney cap hood of the invention includes a cover portion and at least one locking clip which is inserted into a hole in a side wall of the chimney cap. The holes are necessary to allow the smoke to escape from the chimney cap. Also included in the chimney cap hood is at least one guide piece which properly aligns the hood onto the side pieces and provides additional structural support for the chimney cap. The chimney cap hood when attached to the side walls forms a complete chimney cap ready for use.

It is an object of the invention to provide a chimney cap hood which does not use screws, nuts or bolts to attach the hood to the side pieces. The design of the detachable hood allows a person to later remove the hood without the use of tools and without having to remove small pieces like screws, nuts or bolts.

A locking clip is formed by bending material into three portions: a base, an intermediate section and a locking tab. A guide piece is formed by bending material into two portions: a base and a guide main portion.

BRIEF DESCRIPTION OF THE DRAWINGS

Further objects, features and advantages of the invention will become apparent from the following detailed description taken in conjunction with the accompanying drawings showing a preferred embodiment of the invention, in which.

DETAILED DESCRIPTION OF PREFERRED EMBODIMENTS

The invention is directed to a detachable chimney cap hood which can be attached to the side portions of the cap at the manufacturing site or the point of installation without requiring bolts, nuts or screws and allows for the assembly operation to be complete without any tools. When the chimney flue requires cleaning, the hood can later be manually removed without tools due to the nature of the attachment of the hood. The detachable chimney cap hood includes a cover portion and one or more locking clips attached to the cover portion that allows the hood to be locked onto the side walls of the chimney cap. The detachable hood when connected will have sufficient strength to not break away because of inclement weather conditions (including strong winds) or the tampering of small animals or birds. The hood also preferably includes one or more guide pieces to align the hood onto of the cap and to add some further lateral support. The locking clips and guide pieces can be manufactured economically by using scrap metal generated from forming perforations in the side walls which allow smoke to escape. The recycling of the punched out pieces to make the guides and locking clips allows for reduced manufacturing costs.

The chimney cap side pieces to which the hood is attached and the hood itself are made from one or more flat pieces of material. The material is preferably steel but can be any other type of flexible material. The locking clips and guide pieces are made from a material which can be bent, preferably steel.

The side pieces of the chimney cap can have attached flanges. The attached flanges are preferably shorter than the length of each side wall so that the flanges will not contact each other when the side walls are connected together. The attached flanges will form a base which will rest on the chimney flue. The flanges can also be substantially smaller than the length of each side wall while still providing a supporting base for the chimney cap. Flanges around the bottom of the base can also be cemented, bolted or glued to the chimney crown or surrounding area if a permanent chimney cap is desired. A permanent cap requires that the hood be removable in order to clean the one or more flues which the cap covers. The chimney cap hood described herein in especially desirable for a permanent chimney cap because no tools are required for the removal and attachment operation and no loose bolts, nuts or screws are generated by putting on or taking off the hood.

The chimney cap hood can be attached to any side wall of (or material which forms) a chimney cap. The shape of the cap can be any shape including circular, square or rectangular. The type of cap can include collapsible caps, one-piece caps or pre-assembled caps welded together on all sides. The hood should substantially cover the flue of the chimney upon which the chimney cap is placed.

Figure 1:
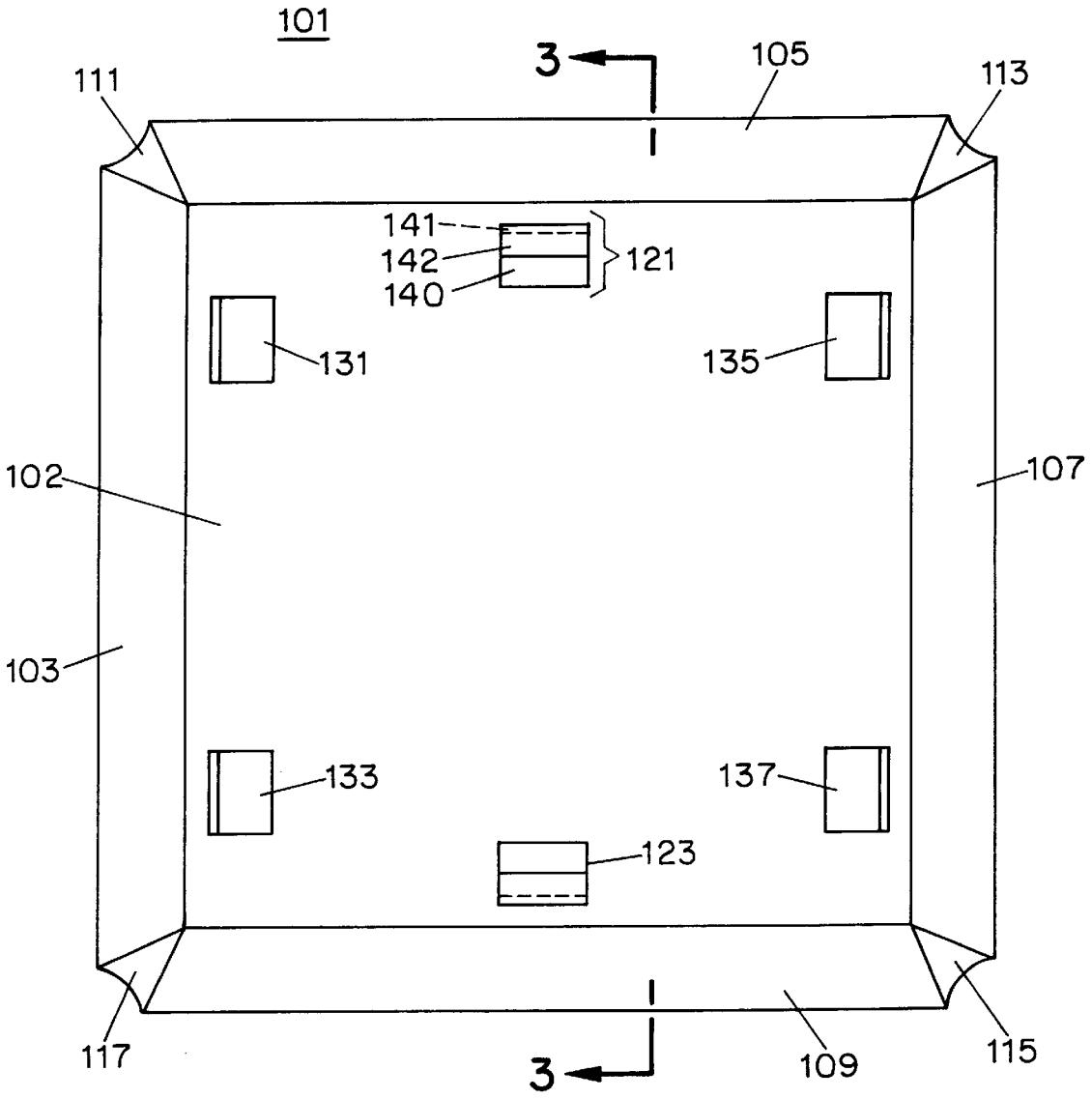
FIG. 1 shows a bottom view of a detachable chimney cap hood made in accordance with the invention.

FIG. 1 shows a bottom view of a detachable chimney cap hood made in accordance with the invention. Hood 101 comprises a cover 102 including four border sections 103, 105, 107 and 109 which are bent upward from the shown plane of the hood to allow precipitation to flow off the chimney cap and also to create a pleasant appearance for the cap. Cover portion 102 also includes corner sections 111, 113, 115 and 117 that are bent to relieve the stress from forming the borders.

Locking clips 121 and 123 are attached to the cover 102 by preferably forming two spot welds each to hold the clips in place. The number of welds can vary and other attachment mechanisms such as glue or screws might be used. The locking clips 121 and 123 are formed by bending the clip material to preferably form a three sided C-shaped configuration, as shown in FIG. 2. One section, comprising the base 140 of the locking clip is welded to the cover section. The base 140 is connected to an intermediate section 142 to a locking tab 144. The locking tab will be inserted into an opening in an adjacent side wall when the hood is attached to the rest of the chimney cap. Guide pieces 131, 133, 135 and 137 are "L" shaped pieces which are also welded to the cover portion 102.

In order to attach the hood to the assembled side pieces, the hood is lowered onto the side walls and is aligned using the guide pieces 131, 133, 135 and 137. The number of guides can be reduced or increased as needed. However, four guides is the preferred number to make sure that the hood is correctly placed on the side walls and also to add additional structural support for the attachment mechanism. In order to attach the hood, the preferred method is for the locking tab 144 of one of the locking clips to be first placed through an existing opening near the top of one side wall. The hood is then aligned on the adjacent side walls using the guide pieces. In order to place the locking tab of the second locking clip into the opposite side wall, the top edge of the opposite side wall is firmly pressed as indicated by the arrow in FIG. 5 towards the center of the cap, allowing the corresponding locking clip to be placed in position. When the opposite side wall is released, it will spring back to its original position and the protruding edge of the locking clip will be placed through the center top hole in the side wall.

Figure 2A:
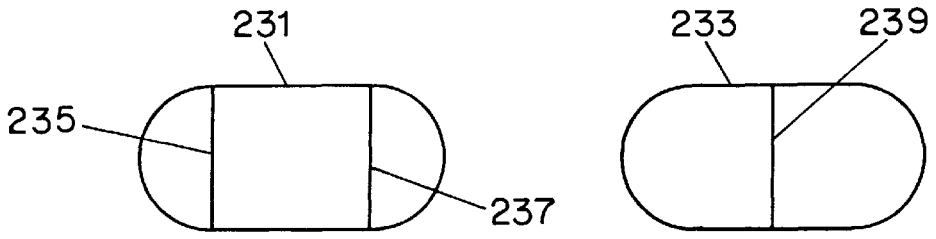
FIG. 2A shows the locking clip and guide piece prior to being bent.
Figure 2B:
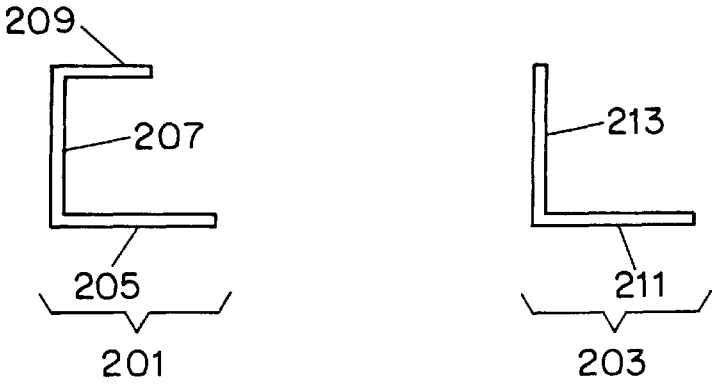
FIG. 2B shows a side view of a locking clip and a guide piece which are part of the chimney cap hood.

A blank from the punched holes in the side walls is shown in FIG. 2A. In the preferred embodiment, the scrap blank can be used as the material for both the locking clips and the guide pieces. However, the locking clips and guide pieces can also be separately cut if desired. The blank can be bent as indicated with lines 235, 237 to form the locking clip 231 as shown in FIG. 2B. Guide piece 233 can also be formed with a single bend indicated by line 239 using blank 233 as shown. The actual shape of the material used for the locking clip and guide piece can be varied including a square or rectangular piece of metal before bending, a circular or oval piece of metal before bending or a polygon piece of metal. Extra bends can also be made in the pieces as long as a portion of the piece can be attached to the chimney cap hood and a portion of the piece can protrude into the hole of the side of the cap. In the case of the guide piece, the metal piece must have a portion to attach to the chimney cap hood and a portion to align the side walls in place.

FIG. 2B shows a side view of a locking clip and a guide piece after being bent. The locking clip 201 is shown as a piece of metal with two bends made in the strip with three portions: the base 205, the intermediate section 207 and locking tab 209. The bends are made to form approximately 90 degree angles between the adjacent portions. Base 205 is spot welded to the inside surface of the chimney cap hood and placed in such a position to enable the locking tab 209 to be positioned through a hole in the side wall and to secure the chimney cap hood to the side wall. The length of the intermediate section 207 is selected so that the locking tab 209 will intersect a hole in the side wall and will hold the side wall in place. Locking tab 209 is made to a sufficient length to contact the hole in the adjacent side wall.

A side view of a guide piece is also shown in FIG. 2B. Guide piece 203 has two portions: a base 211 and a guide section 213. A strip of material is bent in one place to form approximately a 90 degree angle. The base 211 is spot welded to the inside face of the chimney cap hood is a location as shown in FIG. 1. Guide section 213 is positioned to align a side wall of the chimney cap in place so that the hood will be properly attached. Additionally, when the cap is locked in place with the locking clips, extraneous movement will be minimized by the guide pieces. The guide sections can fit either on the outside or the inside of the side wall of the chimney cap.

Figure 3:
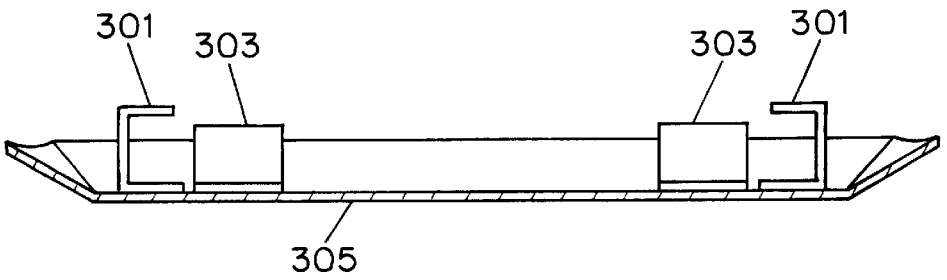
FIG. 3 shows a side view of the locking clips and guide pieces which are attached to a cover portion.

FIG. 3 shows a side perspective of a chimney cap hood with two locking clips and four guide pieces which are attached. The locking clips 301 and guide pieces 303 (of which two are shown) are spot welded to the hood 305. The configuration shown in FIG. 3 shows a locking clip 301 located in each of two opposite sides of the side walls and a pair of guide pieces 303 located on the remaining side walls of the chimney cap. The side perspective shown in FIG. 3 corresponds to the drawing shown in FIG. 1.

Figure 4:
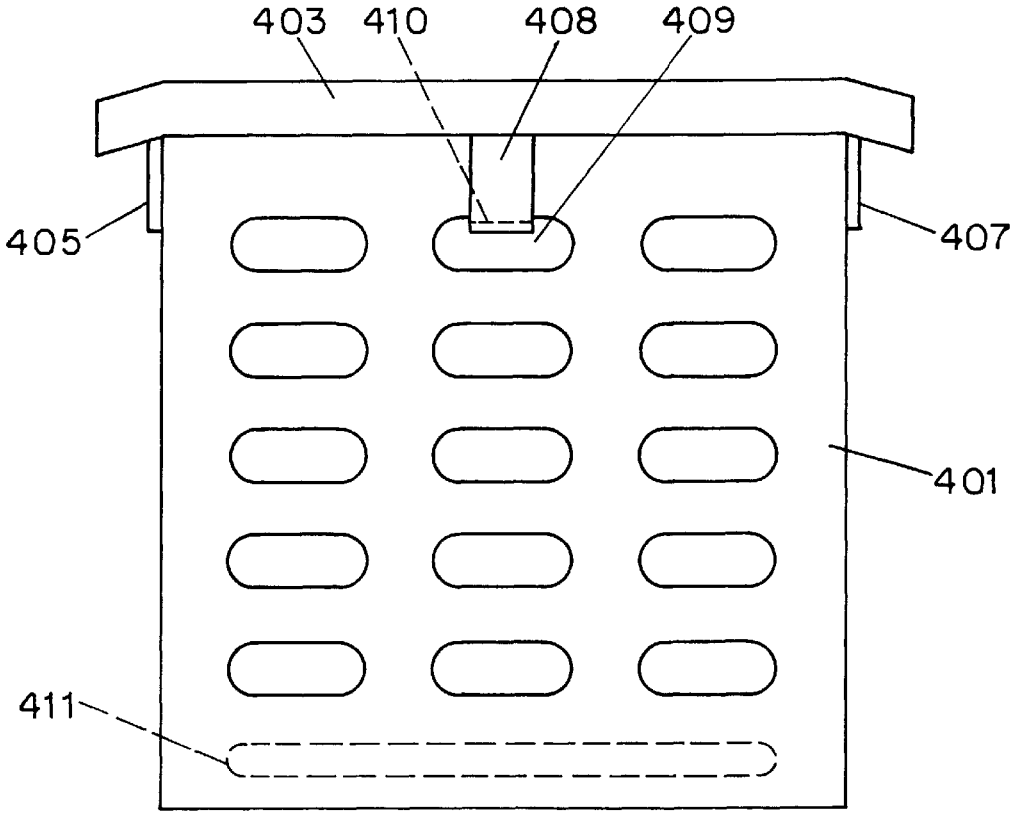
FIG. 4 shows a side view of an assembled chimney cap with an attached hood.

FIG. 4 shows a side view of an assembled chimney cap with an attached hood in accordance with the invention. Side wall 401 is shown with multiple holes from which the chimney smoke will escape. A chimney cap hood 403 is shown placed on top of the side panels. Guide pieces 405 and 407 which are attached to hood 403 help to align the hood on the chimney cap and further hold the hood in place. Locking clip 408 which is also attached to hood 403 extends down from the hood and the locking tab is pushed through the center top hole 409 to hold the cap in place. The dotted lines 410 show the locking tab which is positioned through the hole 409. The length of the intermediate section of the locking clip 408 extending down from the hood is calculated to allow the locking tab to abut the top of the hole. A corresponding locking clip is positioned on the other side of the chimney cap and is not shown. Also not shown are two additional guide pieces for better alignment and extra stabilization of the hood on the chimney cap. A flange 411 on the inside of the side piece of the cap is shown.

Figure 5:
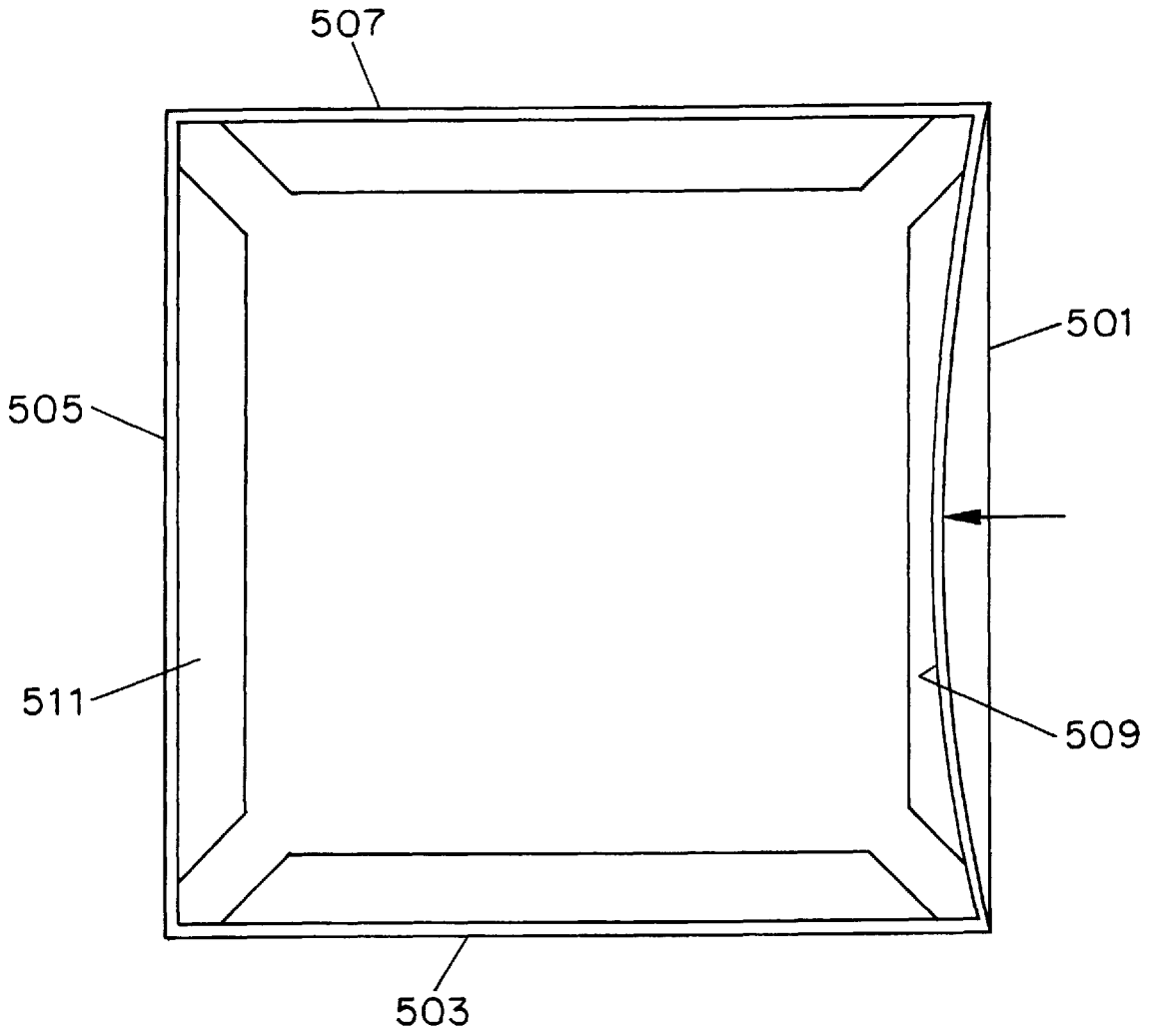
FIG. 5 shows a top view of assembled side walls of a chimney cap without the hood attached.

FIG. 5 is a top view of the assembled side walls of a chimney cap without the chimney cap hood. Side walls 501, 503, 505 and 507 can be made by bending one piece of metal to form a square and by spot welding the two ends together or can be assembled from individual pieces of side walls. Side wall 501, 505 are the side walls which will have a locking clip snap into their its top holes for this example. Alternatively, the other two side walls can be used as the walls to receive the locking clips instead. A portion of each side wall. e.g., portion 511, is bent to further support the hood. A preferred method of placing the hood on the side walls is to slip the locking clip on one side of the hood in place through a hole in an adjacent side wall. Next, the hood is lowered onto the remaining side walls so that the hood fits within the guide pieces. Finally, the side wall 505 is firmly pressed inward (as shown by line 509) so that the remaining locking clip fits through the corresponding hole in the adjacent side wall. When the side wall is released, the locking clip will be locked into place. Since the material of which the side portions are made is flexible, the side portion will allow deformation so the clip can slide past the top portion of the side wall into the corresponding hole in the side wall. In order to remove the detachable hood, a person would press in a side wall with a locking clip so that the protruding edge is removed from the corresponding hole. The remaining locking clips can then be easily removed in a similar manner if necessary.

The foregoing merely illustrates the principles of the invention. It will thus be appreciated that those skilled in the art will be able to devise numerous systems, apparatus and methods which, although not explicitly shown or described herein, embody the principles of the invention and are thus within the spirit and scope of the invention as defined by its claims.

For example, while the description discusses side walls, a circular chimney cap can be used with the detachable hood. While the circular cap may not have discrete side walls, the locking clips and guide pieces will attach to the adjacent holes in different portions of the cap.

I claim:

1. A chimney cap hood for attaching to side members of a chimney cap comprising:

a cover; and first and second locking clips mounted to said cover's underside, each said locking clip including a base attached to said cover, an intermediate section extending outward from said base and a locking tab extending from said intermediate section, each said side member having at least one opening, wherein each said locking tabs is arranged to extend through one of said opening of said side members for attaching to said side member.

2. The chimney cap hood of claim 1, wherein said first and second locking clips are arranged on opposite sides of said hood.

3. The chimney cap hood of claim 1, wherein said base is spot welded to said cover.

4. The chimney cap hood of claim 1, wherein said base forms approximately a 90 degree angle with said intermediate section and said intermediate section forms approximately 90 degree angle with said locking tab.

5. The chimney cap hood of claim 1, further including at least one guide piece attached to said cover.

6. The chimney cap hood of claim 5, wherein each said guide piece is a bent blank comprising a guide base and a guide main portion.

7. The chimney cap hood of claim 6, wherein said guide base is spot welded to said cover.

8. The chimney cap hood of claim 5 for attaching to side members of a chimney cap, wherein said guide main portion is arranged to abut one of said chimney cap side members when said hood is attached to said side members.

9. The chimney cap hood of claim 1, further comprising one or more flanges attached to one of said side members.

10. The chimney cap hood of claim 1, wherein said locking tab extends from said intermediate section toward said cover's center.

11. A chimney cap comprising:

a housing comprising a plurality of side members, at least two said side members having an opening within said side member; and a detachable hood comprising a cover and at least two locking clips attached to said cover;

wherein each said locking clip is arranged to extend through one of said openings in said side members.

12. The chimney cap of claim 11, where said hood further includes at least one guide piece to align said hood on said housing.

13. The chimney cap of claim 12, wherein said guide pieces number four.

14. The chimney cap of claim 11, wherein each said locking clip is a bent blank comprising a base, an intermediate section and a locking tab.

15. The chimney cap of claim 14, wherein said base is spot welded to said cover.

16. The chimney of claim 14, wherein said locking tab extends from said intermediate section toward the center of said cover.

17. The chimney cap of claim 14, wherein said base forms approximately a 90 degree angle with said intermediate section and said intermediate section forms approximately 90 degree angle with said locking tab.

18. The chimney cap of claim 12, wherein each of said guide piece is a bent blank comprising a guide base and a guide main portion.

19. The chimney cap of claim 18, wherein said guide base is spot welded to said cover.

20. The chimney cap of claim 18, wherein said guide main portion abuts one of said side members.

21. The chimney cap of claim 11, further comprising a flange attached to at least one of said side members.

22. The chimney cap of claim 11, wherein said housing is permanently affixed to at least one chimney crown.

* * * * *